US009697783B2

(12) United States Patent
Yeo et al.

(10) Patent No.: US 9,697,783 B2
(45) Date of Patent: Jul. 4, 2017

(54) DISPLAY APPARATUS AND METHOD OF DRIVING THE DISPLAY APPARATUS

(71) Applicant: Samsung Display Co., Ltd., Yongin, Gyeonggi-Do (KR)

(72) Inventors: Dong-Hyun Yeo, Yongin-si (KR); Byung-Kil Jeon, Hwaseong-si (KR); Yong-Bum Kim, Suwon-si (KR); Eun-Seon Kim, Seoul (KR); Suk-Jin Park, Daejeon (KR); Su-Hyun Jeong, Gwangju-si (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 87 days.

(21) Appl. No.: 14/553,538

(22) Filed: Nov. 25, 2014

(65) Prior Publication Data

US 2016/0005367 A1 Jan. 7, 2016

(30) Foreign Application Priority Data

Jul. 4, 2014 (KR) ..... 10-2014-0083987

(51) Int. Cl.
*G09G 3/36* (2006.01)

(52) U.S. Cl.
CPC ..... *G09G 3/3614* (2013.01); *G09G 3/3696* (2013.01); *G09G 2320/0223* (2013.01); *G09G 2320/0285* (2013.01)

(58) Field of Classification Search
CPC ... G09G 2300/0814; G09G 2300/0819; G09G 2300/0823; G09G 2300/0842; G09G 2320/0223; G09G 3/3614
See application file for complete search history.

(56) References Cited

U.S. PATENT DOCUMENTS

| | | | | |
|---|---|---|---|---|
| 2006/0007723 | A1* | 1/2006 | Aoki | G09G 3/3614 365/98 |
| 2008/0284768 | A1* | 11/2008 | Yoshida | G09G 3/2022 345/208 |
| 2012/0229523 | A1* | 9/2012 | Maruyama | G09G 3/3648 345/690 |
| 2014/0043315 | A1* | 2/2014 | Yamazaki | G09G 3/3696 345/212 |

FOREIGN PATENT DOCUMENTS

| | | | |
|---|---|---|---|
| KR | 1020020036684 | A | 5/2002 |
| KR | 1020060049825 | A | 5/2006 |
| KR | 1020060062645 | A | 6/2006 |
| KR | 1020120090888 | A | 8/2012 |

* cited by examiner

*Primary Examiner* — Kenneth Bukowski
(74) *Attorney, Agent, or Firm* — Robert E. Bushnell, Esq.

(57) ABSTRACT

A display apparatus includes a first interpolator configured to generate first correction data for a first polarity corresponding to an input data using a first look up table which stores correction data for the first polarity compensating for a luminance difference between the first polarity and a second polarity opposite to the first polarity of a data voltage for the sub pixel, a first delay compensator configured to apply a correction value to the first correction data for the first polarity and generate second correction data for the first polarity, the correction value compensating for an RC delay based on a pixel position corresponding to the input data.

20 Claims, 10 Drawing Sheets

| GRAY | LUT DATA |
|---|---|
| 0G | lut_0 |
| 64G | lut_1 |
| ~~ | ~~ |
| 4032G | lut_4032 |
| 4095G | lut_4095 |

64 STEP-> 4096 STEP

| GRAY | INTERPOLATED DATA (CALCULATED VALUE) |
|---|---|
| 0G | lut_int_0 |
| 1G | lut_int_1 |
| ~~ | ~~ |
| 4094G | lut_int_4094 |
| 4095G | lut_int_4095 |

FIG. 6

NMD

| | | | | | | | | | | | | |
|---|---|---|---|---|---|---|---|---|---|---|---|---|
| 1 | 0 | 1 | 0 | 1 | 0 | 1 | 0 | 1 | 0 | 1 | 0 | PR1 |
| 0 | 1 | 0 | 1 | 0 | 1 | 0 | 1 | 0 | 1 | 0 | 1 | PR2 |
| 1 | 0 | 1 | 0 | 1 | 0 | 1 | 0 | 1 | 0 | 1 | 0 | |
| 0 | 1 | 0 | 1 | 0 | 1 | 0 | 1 | 0 | 1 | 0 | 1 | |

FIG. 7A

| PC1 | PC2 | | |
|---|---|---|---|
| + | − | + | − |
| − | + | − | + |
| + | − | + | − |
| − | + | − | + |
| + | − | + | − |
| − | + | − | + |
| + | − | + | − |
| − | + | − | + |

| | | | |
|---|---|---|---|
| 1 | 0 | 1 | 0 |
| 1 | 0 | 1 | 0 |
| 1 | 0 | 1 | 0 |
| 1 | 0 | 1 | 0 |
| 0 | 1 | 0 | 1 |
| 0 | 1 | 0 | 1 |
| 0 | 1 | 0 | 1 |
| 0 | 1 | 0 | 1 |

DISPLAY APPARATUS AND METHOD OF DRIVING THE DISPLAY APPARATUS

This application claims priority from and all the benefits accruing therefrom under 35 U.S.C. §119 of Korean Patent Application No. 10-2014-0083987, filed on Jul. 4, 2014, which is hereby incorporated by reference for all purposes as if fully set forth herein.

BACKGROUND OF THE INVENTION

Field of the Invention

Exemplary embodiments of the inventive concept relate to a display apparatus and a method of driving the display apparatus. More particularly, example embodiments of the inventive concept relate to a display apparatus for improving a display quality and a method of driving the display apparatus.

Description of the Related Art

Generally, a liquid crystal display (LCD) apparatus has a relatively small thickness, low weight and low power consumption. Thus the LCD apparatus is used in monitors, laptop computers and cellular phones, etc. The LCD apparatus includes an LCD panel displaying images using a selectively changeable light transmittance characteristic of a liquid crystal while a backlight assembly disposed under the LCD panel provides light to the LCD panel. A driving circuit drives the LCD panel and thereby causes the selective changes of the light transmittance characteristic of the liquid crystals.

The LCD panel includes an array substrate which has a plurality of gate lines, a plurality of crossing data lines, a plurality of thin film transistors and corresponding pixel electrodes. The LCD panel also includes an opposing substrate which has a common electrode. A liquid crystal (LC) layer is interposed between the array substrate and opposing substrate. The driving circuit includes a gate driving part which drives the gate lines of the array substrate and a data driving part which drives the data lines.

When the LCD panel displays an image, a luminance difference between a positive polarity and a negative polarity of a data signal may be observed. A display defect such as stripe may occur due to the luminance difference. For example, when image is scrolled by a frame or observer' eyes synchronized with a polarity change period of the LCD panel, the stripe is observed.

The LCD panel has become larger and thus, a display quality of LCD panel is decreased by Resistor-Capacitor (RC) delays of gate and data signals which drive the LCD panel. Display defects such as luminance reduction, color mixture and stripe may occur due to the RC delays of gate and data signals.

SUMMARY OF THE INVENTION

Exemplary embodiments of the inventive concept provide a display apparatus in order to improve a display quality.

Exemplary embodiments of the inventive concept provide a method of driving the display apparatus.

According to an exemplary embodiment of the inventive concept, there is provided a display apparatus. The display apparatus includes a display panel comprising a gate line, a data line crossing the gate line and a sub pixel electrically connected to the gate line and the data line, a first interpolator configured to generate first correction data for a first polarity corresponding to an input data using a first look up table which stores correction data for the first polarity compensating for a luminance difference between the first polarity and a second polarity opposite to the first polarity of a data voltage for the sub pixel, a first delay compensator configured to apply a correction value to the first correction data for the first polarity and generate second correction data for the first polarity, the correction value compensating for a Resistor-Capacitor (RC) delay based on a pixel position corresponding to the input data, an output selector configured to selectively output the second correction data for the first polarity based on polarity mapping data of K-bit ('K' is a natural number), the polarity mapping data mapped to polarities of K sub pixels according to an inversion mode, and a data driver circuit configured to convert the second correction data for the first polarity to replace the data voltage and output the converted second correction data to the sub pixel.

In an exemplary embodiment, the output selector may be configured to selectively output one of the second correction data for the first polarity and the input data based on 1-bit data of the polarity mapping data.

In an exemplary embodiment, the display apparatus may further include a second interpolator configured to generate first correction data for the second polarity corresponding to an input data using a second look up table which stores correction data for the second polarity compensating for the luminance difference between the first polarity and the second polarity of the data voltage, a second delay compensator configured to apply the compensation value to the first correction data for the second polarity and generate second correction data for the second polarity.

In an exemplary embodiment, the output selector may be configured to selectively output one of the second correction data for the first polarity and the second polarity based 1-bit data of the polarity mapping data.

In an exemplary embodiment, the display apparatus may further include a memory configured to store the correction value, wherein the memory stores a plurality of correction values compensating for the RC delay of the gate line, the plurality of correction values respectively corresponding to a plurality of areas, the plurality of areas being divided in a direction extending the gate line.

In an exemplary embodiment, the display apparatus may further include a first gate driver circuit connected to a first end portion of the gate line and configured to provide the gate line with a gate signal.

In an exemplary embodiment, the display apparatus may further include a second gate driver circuit connected to a second end portion of the gate line and configured to provide the gate line with a gate signal, wherein the first and second gate driver circuits provide the gate line with a same gate signal.

In an exemplary embodiment, the display apparatus may further include a memory configured to store the correction value, wherein the memory stores a plurality of correction values compensating for RC delays of the gate line and the data line, the plurality of correction values respectively corresponding to a plurality of areas, the plurality of areas being divided as a matrixarray.

In an exemplary embodiment, the display apparatus may further include a memory configured to store the polarity mapping data of the K-bit, wherein the output selector selects the first polarity when the 1-bit data of the polarity mapping data is '1', and the output selector selects the second polarity when the 1-bit data of the polarity mapping data is '0'.

In an exemplary embodiment, the memory may be configured to store specified polarity mapping data of Q-bit corresponding to a specified test pattern image.

According to an exemplary embodiment of the inventive concept, there is provided a method of driving a display apparatus which a gate line, a data line crossing the gate line and a sub pixel which is electrically connected to the gate line and the data line. The method includes calculating first correction data for a first polarity corresponding to an input data using a first look up table which stores correction data for the first polarity compensating for a luminance difference between the first polarity and a second polarity opposite to the first polarity of a data voltage for the sub pixel, applying a correction value to the first correction data for the first polarity to calculate second correction data for the first polarity, the correction value compensating for a Resistor-Capacitor (RC) delay based on a pixel position corresponding to the input data, selectively outputting the second correction data for the first polarity based on polarity mapping data of K-bit ('K' is a natural number), the polarity mapping data being mapped to polarities of K sub pixels according to an inversion mode, and converting the second correction data for the first polarity to replace the data voltage to output to the sub pixel.

In an exemplary embodiment, the selectively outputting the second correction data may include selectively outputting one of the second correction data for the first polarity and the input data based on 1-bit data of the polarity mapping data.

In an exemplary embodiment, the method may further include calculating first correction data for the second polarity corresponding to an input data using a second look up table which stores correction data for the second polarity compensating for the luminance difference between the first polarity and the second polarity of the data voltage, and applying the correction value to the first correction data for the second polarity to calculate second correction data for the second polarity.

In an exemplary embodiment, the method may further include selectively outputting one of the second correction data for the first polarity and the second polarity input data based on 1-bit data of the polarity mapping data.

In an exemplary embodiment, the second correction data may be calculated using a plurality of correction values compensating for the RC delay of the gate line, the plurality of correction values respectively corresponding to a plurality of areas, the plurality of areas being divided in a direction extending the gate line.

In an exemplary embodiment, the method may further include providing a first end portion of the gate line with a gate signal.

In an exemplary embodiment, the method may further include providing a second end portion of the gate line with a gate signal, wherein the first and second end portions of the gate line receive a same gate signal.

In an exemplary embodiment, the second correction data is calculated using a plurality of correction values compensating for RC delays of the gate line and the data line, the plurality of correction values respectively corresponding to a plurality of areas, the plurality of areas being divided as a matrixarray.

In an exemplary embodiment, the first polarity is selected when the 1-bit data of the polarity mapping data is '1', and the second polarity is selected when the 1-bit data of the polarity mapping data is '0'.

In an exemplary embodiment, the calculating the second correction data may further include selectively outputting the second correction data corresponding to the input data based on specified polarity mapping data of Q-bit corresponding to a specified test pattern image.

According to the inventive concept, the luminance difference between the positive polarity and the negative polarity with respect to a same grayscale may be compensated. In addition, the RC delay of the gate line may be compensated. Therefore, the display defects such as flicker and stripe occurring due to the luminance difference and the RC delay may be decreased and thus a display quality may be improved.

BRIEF DESCRIPTION OF THE DRAWINGS

The above and other features and advantages of the inventive concept will become more apparent by describing in detailed exemplary embodiments thereof with reference to the accompanying drawings, in which:

FIG. 6 is a conceptual diagram illustrating normal polarity mapping data applied to an output selector of FIG. 2;

FIGS. 7A to 7C are conceptual diagrams illustrating specified polarity mapping data applied to an output selector of FIG. 2;

DETAILED DESCRIPTION OF THE INVENTION

Hereinafter, the inventive concept will be explained in detail with reference to the accompanying drawings.

Figure 1:
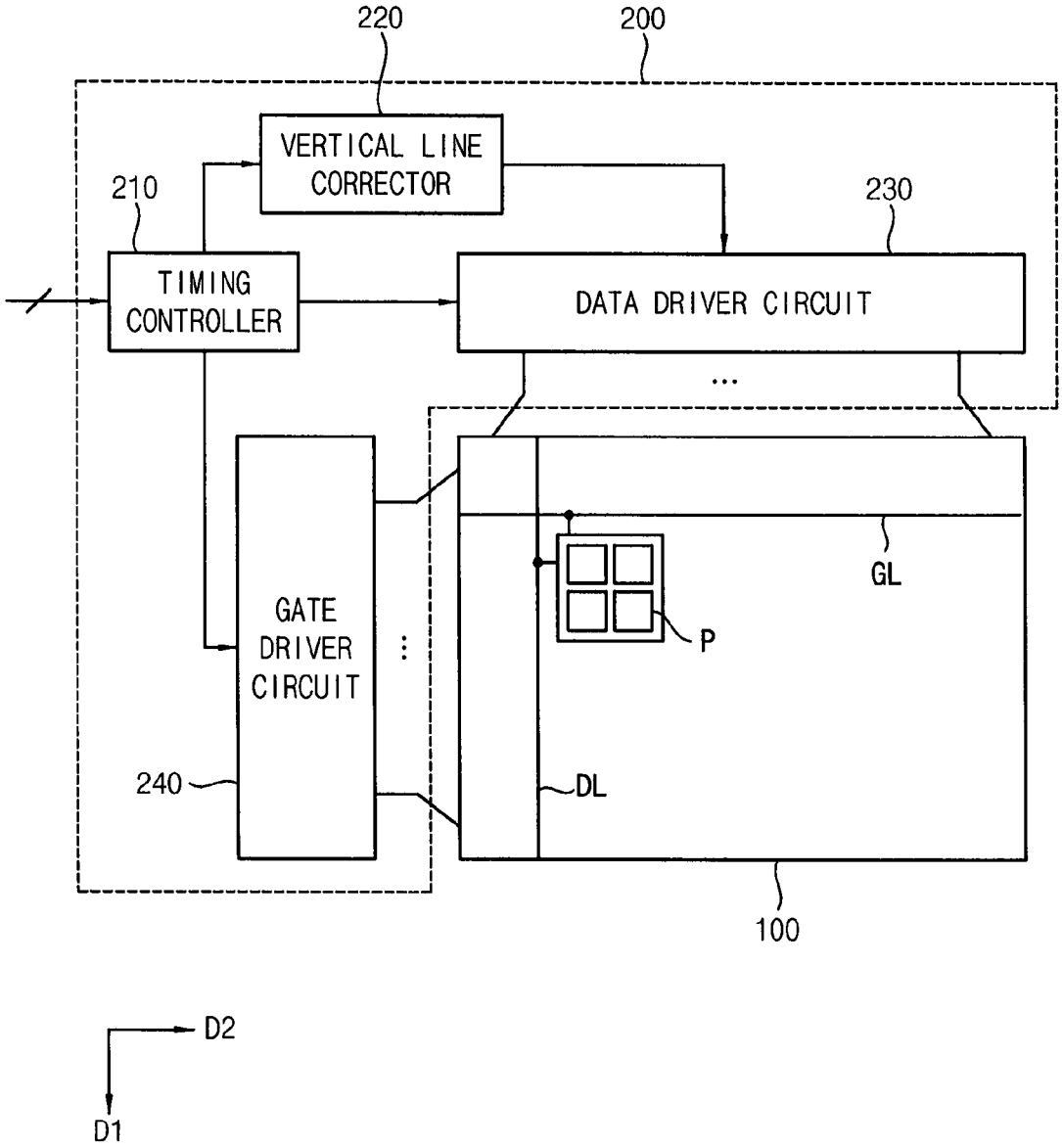
FIG. 1 is a plan view illustrating a display apparatus according to an exemplary embodiment.

FIG. 1 is a plan view illustrating a display apparatus according to an exemplary embodiment.

Referring to FIG. 1, the display apparatus may include a display panel 100 and a panel driving part 200 which is configured to drive the display panel 100. The panel driving part 200 may include a timing controller 210, a vertical line corrector 220, a data driver circuit 230 and a gate driver circuit 240.

The display panel 100 may include a plurality of data lines DL, a plurality of gate lines GL and a plurality of sub pixels P.

The plurality of data lines DL extends in a first direction D1 and is arranged in a second direction D2 crossing the first direction D1.

The plurality of gate lines GL extends in the second direction D2 and is arranged in the first direction D1.

The plurality of sub pixels P is arranged as a matrix array which includes a plurality of sub pixel rows and a plurality of sub pixel columns Each of the sub pixels P may include a switching element TR which is connected to a data line DL and a gate line GL, and a liquid crystal capacitor LCC is connected to the switching element TR. The plurality of sub pixels may include red, green and blue sub pixels.

The timing controller 210 is configured to generally drive the display apparatus. The timing controller 210 is configured to control an operation of the vertical line corrector 220, the data driver circuit 230 and the gate driver circuit 240.

The timing controller 210 is configured to receive input data and a synchronization signal, and to provide the vertical line corrector 220 with the input data. The timing controller 210 is configured to generate a data control signal and a gate control signal which respectively control the data driver circuit 230 and the gate driver circuit 240 using the synchronization signal. The data control signal may include a horizontal synchronization signal, a data enable signal, a load signal and a polarity control signal. The polarity control signal is for controlling a polarity of a data voltage f the sub pixel of the display panel 100. The polarity control signal may swing by every frame period. The gate control signal may include a vertical synchronization signal, a vertical start signal, an output enable signal and a plurality of clock signals.

The vertical line corrector 220 is configured to generate correction data which compensate for a luminance difference between a first polarity and a second polarity with respect to the input data of a same grayscale and a Resistor-Capacitor (RC) delay at a position of a sub pixel corresponding to the input data. The first polarity may be a positive polarity (+) or a negative polarity (−), and the second polarity may be a polarity, that is the negative polarity (−) or the positive polarity (+), opposite to the first polarity with respect to a reference voltage.

The vertical line corrector 220 is configured to provide the data driver circuit 230 with the correction data for the input data using normal polarity mapping data based on a sub pixel structure and an inversion mode of the display panel 100.

In addition, the vertical line corrector 220 is configured to control the polarity of the input data corresponding to a specified test pattern image using specified polarity mapping data based on a specified inversion mode. When the specified test pattern image is displayed on the display panel 100, display defects such as flicker and stripe are observed by the inversion mode of the display panel 100. Thus, the specified inversion mode is the inversion mode preset for decreasing the display defect.

The inversion mode may be preset variously, such as a 1-dot inversion mode, a 2-dot inversion mode, a (1+2)-dot inversion mode and so on.

The data driver circuit 230 is configured to convert the correction data provided from the vertical line corrector 220 to replace a data voltage using a gamma voltage based on the data control signal and to output the data voltage to the data line of the display panel 100.

The gate driver circuit 240 is configured to generate a plurality of gate signals based on the gate control signal and to sequentially output the plurality of gate signals to the plurality of gate signals.

The gate driver circuit 240 may have a single gate structure which provides a gate signal with a first end portion of the gate line GL. Alternatively, the gate driver circuit 240 may have a dual gate structure which provides first and second end portions of the gate line GL with a same gate signal.

Figure 2:
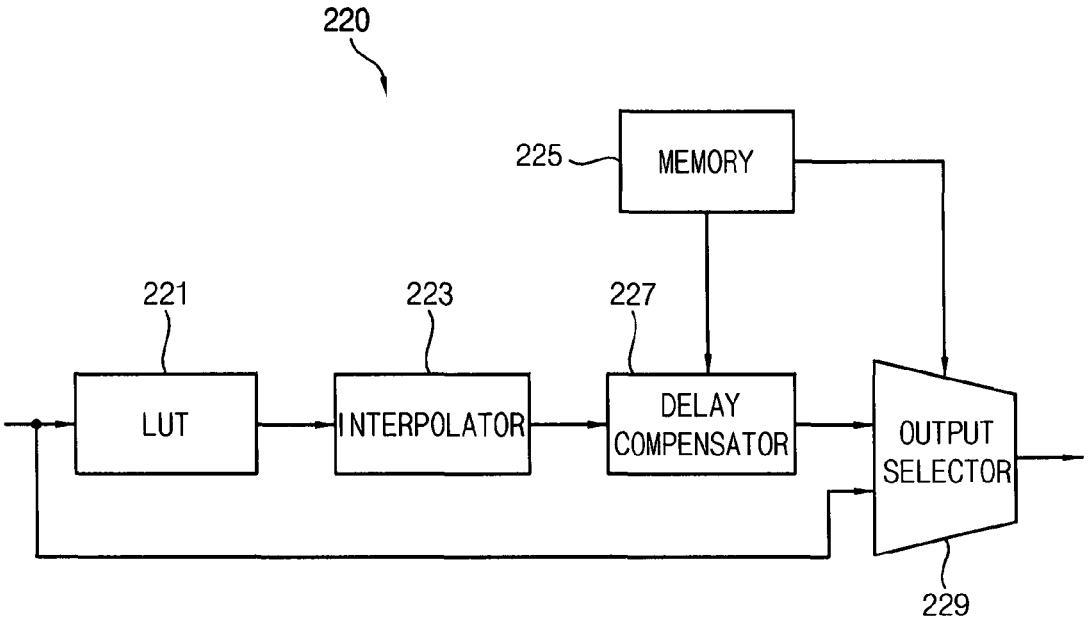
FIG. 2 is a block diagram illustrating a vertical line corrector of FIG. 1.
Figure 3:
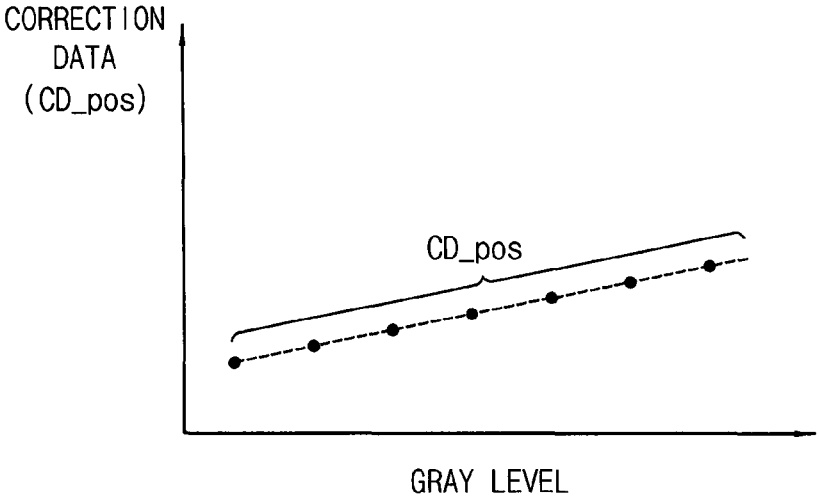
FIG. 3 is a conceptual diagram illustrating correction data stored in a look up table of FIG. 2.
Figures 4, 5:
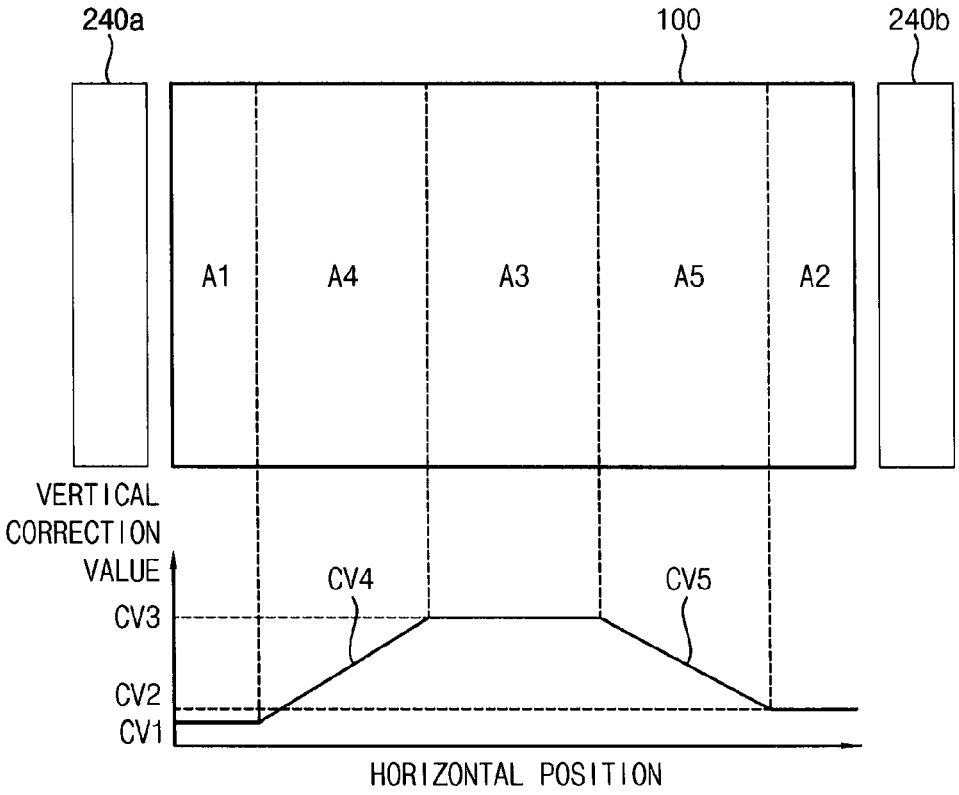
FIG. 4 is a conceptual diagram illustrating an interpolator of FIG. 2.
FIG. 5 is a conceptual diagram illustrating a delay compensation value applied to a delay compensator of FIG. 2.
Figure 7B:
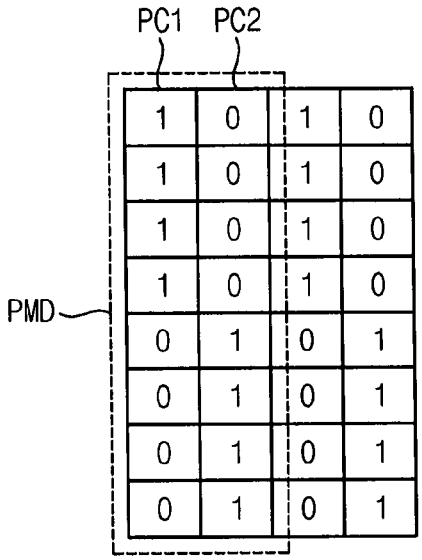
Figure 7C:
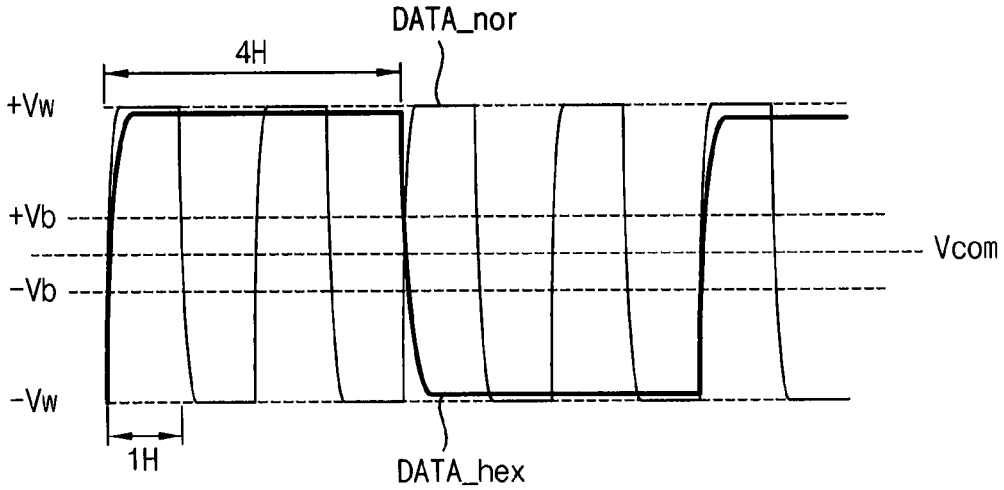

FIG. 2 is a block diagram illustrating a vertical line corrector of FIG. 1. FIG. 3 is a conceptual diagram illustrating correction data stored in a look up table of FIG. 2. FIG. 4 is a conceptual diagram illustrating an interpolator of FIG. 2. FIG. 5 is a conceptual diagram illustrating a delay compensation value applied to a delay compensator of FIG. 2. FIG. 6 is a conceptual diagram illustrating normal polarity mapping data applied to an output selector of FIG. 2. FIGS. 7A to 7C are conceptual diagrams illustrating specified polarity mapping data applied to an output selector of FIG. 2

Referring to FIG. 2, the vertical line corrector 220 may include a look up table 221, an interpolator 223, a memory 225, a delay compensator 227 and an output selector 229.

In an exemplary embodiment, the look up table 221 is configured to store correction data for the positive polarity or the negative polarity. The correction data compensate a luminance difference between a positive polarity voltage and a negative polarity voltage with respect to the input data of a same grayscale. The look up table 221 stores the correction data for the positive polarity or the negative polarity so that a size of the memory 225 may be decreased.

Referring to FIG. 3, the look up table 221 stores correction data CD_pos for the positive polarity which compensates for a positive polarity luminance with respect to a negative polarity luminance. The correction data may be calculated by multiplying the input data by a luminance difference ratio. Alternatively, the correction data may be data corresponding to a luminance difference between a positive polarity luminance and a negative polarity luminance. The correction data may be calculated by various methods.

The look up table 221 may store a plurality of first correction data corresponding to a plurality of sample grayscales which are sampled from total grayscales. For example, when the input data are 12-bit data having the total grayscales of 4096 grayscales, the look up table 221 may store 64 first correction data corresponding to 64 sample grayscales.

The interpolator 223 is configured to calculate a plurality of first correction data corresponding to remaining grayscales which are not sampled from the total grayscales, using the plurality of first correction data stored in the look up table 221 through an interpolation algorithm.

Referring to FIG. 4, the look up table 221 stores a plurality of first correction data (lut_0, lut_1, . . . , lut_62 and lut_63) respectively corresponding to 64 sample grayscales (0 grayscale 1G, 64 grayscale 64G, . . . , 4032 grayscale 4032G and 4095 grayscale 4095G) among the total grayscales (0 grayscale, . . . , 4095 grayscale). The interpolator 223 calculates the first correction data corresponding to the remaining grayscales which are between 64 sample grayscales (0G, 64G, . . . , 4032G and 4095G) and are not sampled from the total grayscales through the interpolation algorithm, and thus the first correction data (lut_int_0, lut_int_1, . . . , lut_int_4094 and lut_int_4095) of the 4096 total grayscales may be calculated.

The memory 225 is configured to store a horizontal correction value according to a horizontal position of the display panel 100. The display panel 100 includes a gate line GL extending in a horizontal direction, that is, the second direction D2. The horizontal correction value of the horizontal position of the display panel 100 is a correction value calculated to compensate for an RC delay of the gate line GL, and is stored in the memory 225.

Referring to FIGS. 1 and 5, when the gate driver circuit 240 has the dual gate structure, a first gate driver circuit 240*a* is connected to a first end portion of the gate line GL and a second gate driver circuit 240*b* is connected to a second end portion of the gate line GL. The first and second gate driver circuits 240*a* and 240*b* concurrently provide the first and second end portions of the gate line GL with a same gate signal. The display panel 100 driven through the first and second gate driver circuits 240*a* and 240*b* is divided into a plurality of horizontal areas A1, A2, A3, A4 and A5 based on the RC delay of the gate signal transferred through the gate line GL.

In the dual gate structure, the RC delay of the gate signal gradually increases from an edge portion of the display panel 100 toward a central portion.

For example, the display panel 100 may include a first area A1, a second area A2, a third area A3, a fourth area A4 and a fifth area A5. The first area A1 is adjacent to a first edge portion in which the first gate driver circuit 240*a* is disposed. The second area A2 is adjacent to a second edge portion in which the second gate driver circuit 240*b* is disposed and is opposite to the first edge portion. The third area A3 corresponds to the central portion of the display panel 100. The fourth area A4 is between the first area A1 and the third area A3 and the fifth area A5 which is between the third area A3 and the second area A2.

According to the RC delay of the gate signal, a first horizontal correction value CV1 is calculated corresponding to the first area A1. A second horizontal correction value CV2 is calculated corresponding to the second area A2 and is different from the first horizontal correction value CV1. A third horizontal correction value CV3 is calculated corresponding to the third area A3. A plurality of fourth horizontal correction values CV4 is calculated using the first and third horizontal correction values CV1 and CV3 corresponding to the fourth area A4. The plurality of fourth horizontal correction values CV4 linearly increase from the first horizontal correction value CV1 to the third horizontal correction value CV3. A plurality of fifth horizontal correction values CV5 are calculated using the second and third horizontal correction values CV2 and CV3 corresponding to the fifth area A5. The plurality of fifth horizontal correction values CV5 linearly decrease from the third horizontal correction value CV3 to the second horizontal correction value CV2.

As described above, the calculated horizontal correction values are stored in the memory 225.

In addition, the memory 225 stores a plurality of normal polarity mapping data NMD and a plurality of specified polarity mapping data PMD. The normal polarity mapping data NMD may be K-bit data, and the specified polarity mapping data may be Q-bit data (wherein, K and Q are natural numbers).

The normal polarity mapping data NMD are data mapped to polarities of the sub pixels according to a sub pixel structure and an inversion mode of the display panel 100.

For example, referring to FIG. 6, according to the sub pixel substrate and a 1-dot inversion mode of the display panel 100, the normal polarity mapping data NMD may be preset to 24-bit data corresponding to sub pixels of a (12×2) matrixarray. The normal polarity mapping data NMD is preset to polarities of 12 sub pixels in a first sub pixel row PR1 and 12 sub pixels in a second sub pixel row PR2. When 1-bit data of the normal polarity mapping data NMD are '0', the corresponding sub pixel may be controlled to the negative polarity. When 1-bit data of the normal polarity mapping data NMD are '1', the corresponding sub pixel may be controlled to the positive polarity. A bit number of the normal polarity mapping data NMD may be preset variously.

The memory 225 may store a plurality of normal polarity mapping data NMD respectively corresponding to various inversion modes. The normal polarity mapping data NMD may be selected based on the inversion mode of the display panel 100 among the plurality of normal polarity mapping data NMD stored in the memory 225.

The specified polarity mapping data PMD preset based on a specified inversion mode control the polarities of the input data corresponding to a specified test pattern image including display defects such as flicker and stripe which are observed by the inversion mode of the display panel 100. Thus, the display defects of the specified test pattern image may be decreased.

For example, referring to FIGS. 7A and 7C, the display panel has the inversion mode of the 1-dot inversion mode, an odd-numbered sub pixel column of the display panel displays a black grayscale image and an even-numbered sub pixel column of the display panel displays a white grayscale image.

According to the 1-dot inversion mode, a data voltage DATA_nor of the white grayscale applied to the second sub pixel column PC2 swings between white voltages +Vw and −Vw of the positive polarity and the negative polarity by a 1-horizontal period (1H). A voltage difference between the white voltages +Vw and −Vw of the positive and negative polarities is a maximum voltage difference. Thus, a response time of the liquid crystal is later than a change time of the data voltage, and thus, the display defects such as the flicker and the stripe is observed.

In an exemplary embodiment, when a stripe test pattern image, that is, the specified test pattern image is displayed on the display panel having the 1-dot inversion mode, the polarities of the stripe test pattern image are controlled using the specified polarity mapping data PMD based on the specified inversion mode which is preset to decrease the display defects.

For example, referring to FIG. 7B, the specified polarity mapping data PMD may be preset to 16-bit data corresponding to sub pixels of a (2×8) matrixarray. The specified polarity mapping data PMD is preset to polarities of 8 sub pixels in a first sub pixel column PC1 and 8 sub pixels in a second sub pixel column PC2 adjacent to the first sub pixel column PC1.

According to the specified polarity mapping data PMD preset to 16-bit data as shown in FIG. 7B, 4 sub pixels in the first sub pixel column PC1 may be controlled to the positive polarity (+), and then, remaining 4 sub pixels in the first sub pixel column PC1 may be controlled to the negative polarity (−). In the second sub pixel column PC2 adjacent to the first sub pixel column PC1, 4 sub pixels may be controlled to the negative polarity (−), and then, 4 sub pixels may be controlled to g the positive polarity (+), opposite to the first sub pixel column PC1.

Referring to a data voltage DATA_hex applied to the second sub pixel column PC2 based on the specified polarity mapping data PMD as shown in FIG. 7C, the data voltage DATA_hex swings between the white voltages +Vw and −Vw of the positive and negative polarities by every 4-horizontal period (4H).

Therefore, a swing period of the data voltage DATA_hex, that is, the 4-horizontal period (4H) is longer than a swing period of the data voltage DATA_nor, that is, the 1-horizontal period (1H). The response time of the liquid crystal may be shorter than the change time of the data voltage, and thus, the display defects such as the flicker and the stripe may be prevented from being observed in the specified test pattern image.

The memory 225 may store a plurality of specified polarity mapping data PMD corresponding to variously specified test pattern images. The specified polarity mapping data PMD may be selected based on the specified test pattern image displayed on the display panel 100 and the inversion mode of the display panel 100 among the plurality of specified polarity mapping data PMD stored in the memory 225.

The delay compensator 227 is configured to apply the horizontal correction value provided from the memory 225 to the first correction data provided from the interpolator 223 and to calculate second correction data compensating for the RC delay.

For example, the delay compensator 227 applies the horizontal correction value provided from the memory 225 corresponding to the sub pixel position of the input data to the first correction data compensated for the luminance difference from the interpolator 223, and calculates the second correction data for the input data.

The output selector 229*b* selectively outputs one of the input data and the second correction data for the positive polarity based on the normal polarity mapping data or the specified polarity mapping data stored in the memory 225.

Based on the normal polarity mapping data NMD or the specified polarity mapping data PMD, when 1-bit mapping data are '0', the output selector 229 determines the polarity of the input data to the negative polarity and outputs the input data. However, when 1-bit mapping data are '1', the output selector 229 determines the polarity of the input data to the positive polarity and outputs the second correction data for the positive polarity which compensate for the luminance difference and the RC delay.

In the exemplary embodiment, the look up table 221 stores the first correction data compensating for the luminance difference of the positive polarity and the delay compensator 227 applies the horizontal correction value to the first correction data for the positive polarity and thus calculates the second correction data for the positive polarity. Consequentially, the vertical line corrector 220 according to the exemplary embodiment corrects the input data corresponding to the sub pixel having the positive polarity.

Although not shown figures, the delay compensator 227 may apply the horizontal correction value to the input data and thus, calculate delay correction data. Then, when the 1-bit mapping data of the normal or specified polarity mapping data are '0', the output selector 229 outputs the delay correction data for the negative polarity compensating for only the RC delay. However, when the 1-bit mapping data of the normal or specified polarity mapping data are '1', the output selector 229 outputs the second correction data for the positive polarity which compensate for all the luminance difference and RC delay. This case, the delay correction data compensating for only the RC delay may be applied to the sub pixel for the negative polarity and the second correction data compensating for all the luminance difference and the RC delay may be applied to the sub pixel for the positive polarity.

Figure 8:
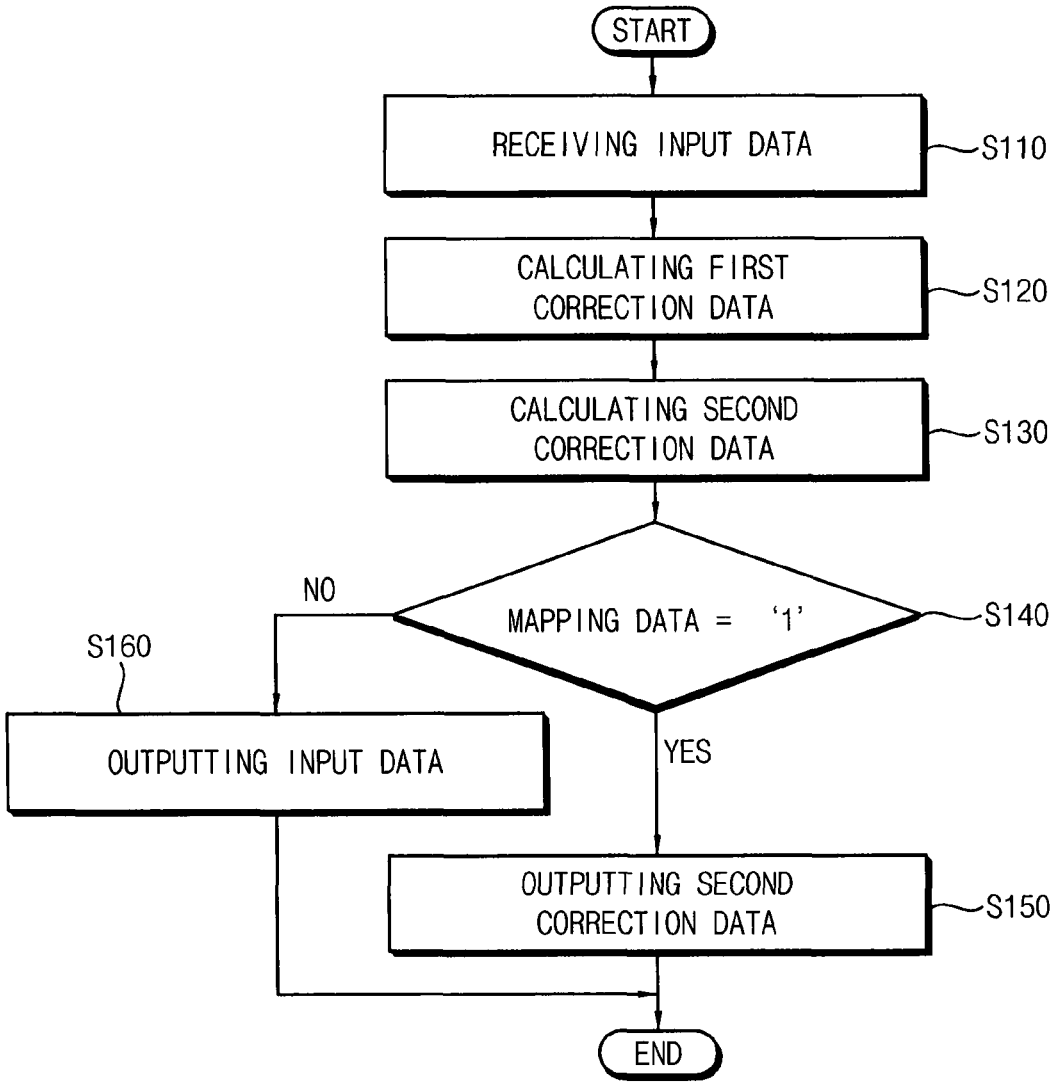
FIG. 8 is a flowchart illustrating a method of driving a display apparatus according to an exemplary embodiment.

FIG. 8 is a flowchart illustrating a method of driving a display apparatus according to an exemplary embodiment.

Referring to FIGS. 2 and 8, the input data are received (Step S110). The look up table 221 stores correction data for the positive polarity compensating for a luminance of the positive polarity based on the luminance of the negative polarity with respect to a same grayscale.

The look up table 221 and the interpolator 225 calculate the first correction data for the input data (Step S120).

The delay compensator 227 receives the first correction data. The delay compensator 227 applies the horizontal correction value corresponding to the sub pixel position of the input data to the first correction data, and thus calculates the second correction data for the input data (Step S130). For example, when the sub pixel of the input data are located in the third area A3 among the first to fifth areas A1 to A5 shown in FIG. 5, the delay compensator 227 applies the third horizontal correction value CV3 corresponding to the third area A3 to the first correction data and calculates the second correction data for the input data.

The output selector 229 selectively outputs one of the input data and the second correction data based on the 1-bit mapping data of the normal polarity mapping data NMD or specified polarity mapping data PMD stored in the memory 225.

For example, when the 1-bit mapping data are '1', the output selector 229 determines the polarity of the sub pixel corresponding to the input data to the positive polarity and outputs the second correction data compensating for all the luminance difference and RC delay (Step S150).

Alternatively, when the 1-bit mapping data are '0', the output selector 229 determines the polarity of the sub pixel corresponding to the input data to the negative polarity and outputs the input data which are not compensated (Step S160).

Although not shown figures, the delay compensator 227 may apply the horizontal correction value to the input data and thus, calculate delay correction data. Then, when the 1-bit mapping data of the normal or specified polarity mapping data are '0', the output selector 229 outputs the delay correction data for the negative polarity compensating for only the RC delay. However, when the 1-bit mapping data of the normal or specified polarity mapping data are '1', the output selector 229 outputs the second correction data for the positive polarity which compensates for all the luminance difference and the RC delay. This case, the delay correction data compensated for only the RC delay may be applied to the sub pixel for the negative polarity and the second correction data compensating for all the luminance difference and the RC delay may be applied to the sub pixel for the positive polarity.

According to the exemplary embodiment, the luminance difference between the positive polarity and the negative polarity with respect to a same grayscale may be compensated. In addition, the RC delay of the gate line may be compensated. Therefore, the display defects such as the flicker and the stripe occurring by the luminance difference and the RC delay may be decreased, and thus a display quality may be improved.

Figure 9:
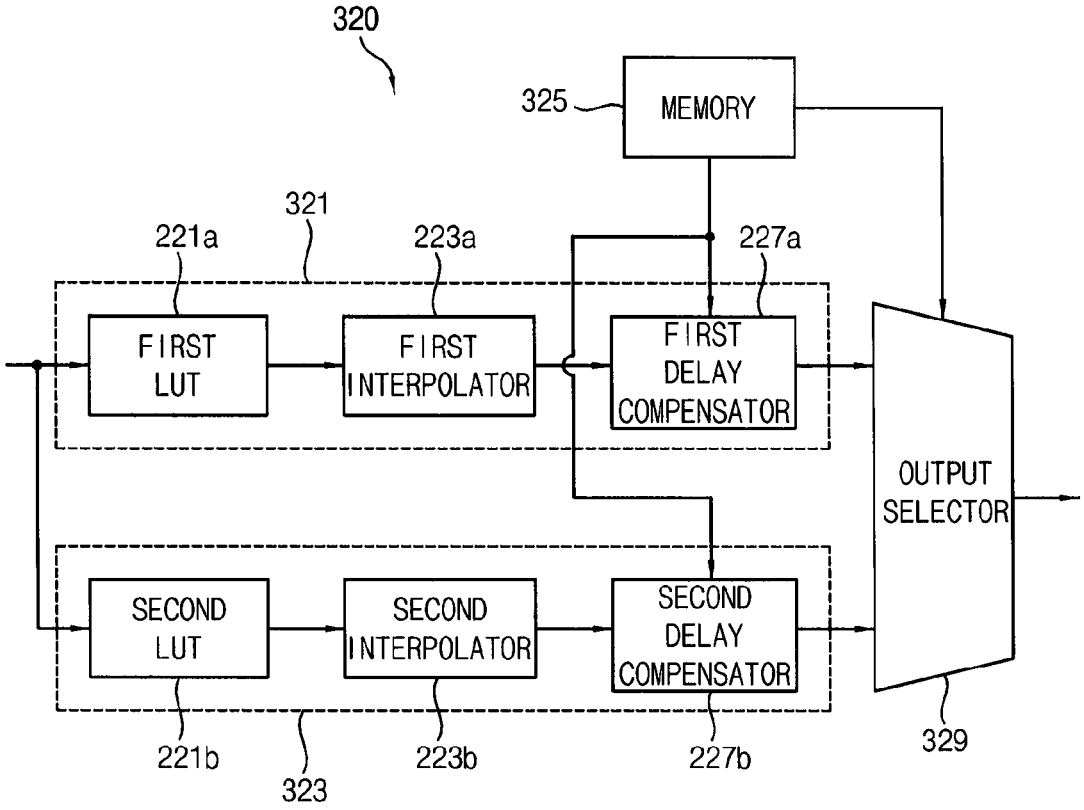
FIG. 9 is a block diagram illustrating a vertical line corrector according to an exemplary embodiment.
Figure 10:
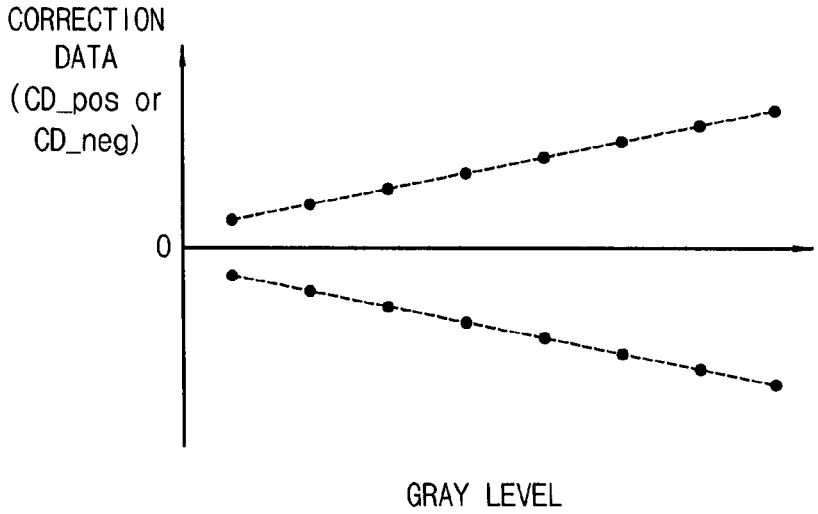
FIG. 10 is a conceptual diagram illustrating correction data stored in first and second look up tables of FIG. 9.

FIG. 9 is a block diagram illustrating a vertical line corrector according to an exemplary embodiment. FIG. 10 is a conceptual diagram illustrating correction data stored in first and second look up tables of FIG. 9.

Hereinafter, the same reference numerals are used to refer to the same or like parts as those described in the previous exemplary embodiments, and the same detailed explanations are simplified Referring to FIGS. 1 and 9, the vertical line corrector 320 may include a positive polarity compensator 321, a negative polarity compensator 323, a memory 325 and an output selector 329.

The positive polarity compensator 321 is configured to calculate correction data for a positive polarity which compensate for a luminance difference between the positive polarity and the negative polarity with respect to the input data of a same grayscale and an RC delay at a position of a sub pixel corresponding to the input data.

The positive polarity compensator 321 may include a first look up table 221*a*, a first interpolator 223*a* and a first delay compensator 227*a*.

Referring to FIG. 10, the first look up table 221*a* 221 is configured to store first positive polarity correction data CD_pos which compensate for a luminance difference between the positive polarity and the negative polarity.

The first look up table 221*a* may store a plurality of first positive polarity correction data CD_pos corresponding to a plurality of sample grayscales which are sampled from total grayscales. For example, when the input data are 12-bit data having the total grayscales of 4096 grayscales, the first look up table 221*a* may store 64 first positive polarity correction data CD_pos corresponding to 64 sample grayscales.

The first interpolator 223*a* is configured to calculate a plurality of first positive polarity correction data CD_pos corresponding to remaining grayscales which are not sampled from the total grayscales, using the plurality of first positive polarity correction data CD_pos stored in the first look up table 221*a* through an interpolation algorithm.

The first delay compensator 227*a* is configured to apply a horizontal correction value provided from the memory 325 corresponding to a sub pixel position of the input data to the first positive polarity correction data CD_pos provided from the first interpolator 223*a* and thus, to calculate the second positive polarity correction data which are compensated for the RC delay.

As described referring to FIG. 5, the memory 325 stores a plurality of horizontal correction values corresponding to a plurality of areas A1, A2, A3, A4 and A5 which is divided in a horizontal direction of the display panel.

In addition, the memory 325 stores a plurality of normal polarity mapping data as described referring to FIG. 6 and a plurality of specified polarity mapping data as described referring to FIGS. 7A to 7C.

The negative polarity compensator 323 is configured to calculate correction data for a negative polarity which compensate for a luminance difference between the positive polarity and the negative polarity with respect to the input data of a same grayscale and an RC delay at a position of a sub pixel corresponding to the input data.

The negative polarity compensator 323 may include a second look up table 221*b*, a second interpolator 223*b* and a second delay compensator 227*b*.

Referring to FIG. 10, the second look up table 221*b* is configured to store first negative polarity correction data CD_neg which compensate for a luminance difference between the positive polarity and the negative polarity.

The second look up table 221*b* may store a plurality of first negative polarity correction data CD_neg corresponding to a plurality of sample grayscales which are sampled from total grayscales. For example, when the input data are 12-bit data having the total grayscales of 4096 grayscales, the second look up table 221*b* may store 64 first negative polarity correction data CD_neg corresponding to 64 sample grayscales.

The second interpolator 223*b* is configured to calculate a plurality of first negative polarity correction data CD_neg corresponding to remaining grayscales which are not sampled from the total grayscales, using the plurality of first negative polarity correction data CD_neg stored in the second look up table 221*b* through an interpolation algorithm.

The second delay compensator 227*b* is configured to apply a horizontal correction value provided from the memory 325 corresponding to a sub pixel position of the input data to the first negative polarity correction data CD_neg provided from the second interpolator 223*b* and thus, to calculate the second positive polarity correction data which are compensated for the RC delay.

The output selector 329 selectively outputs one of the second positive polarity correction data and the second negative polarity correction data, based on 1-bit mapping data of the normal polarity mapping data or the specified polarity mapping data provided from the memory 325.

When the 1-bit mapping data of the normal polarity mapping data or the specified polarity mapping data are '1', the output selector 329 determines the polarity of the sub pixel corresponding to the input data to the positive polarity and outputs the second positive polarity correction data. Alternatively, the 1-bit mapping data of the normal polarity mapping data or the specified polarity mapping data are '0', the output selector 329 determines the negative of the sub pixel corresponding to the input data to the negative polarity and outputs the second negative polarity correction data.

According to the exemplary embodiment, the luminance difference between the positive polarity and the negative polarity with respect to a same grayscale may be compensated. In addition, the RC delay of the gate line may be compensated. Therefore, the display defects such as the flicker and the stripe occurring by the luminance difference and the RC delay may be decreased, and thus a display quality may be improved.

Figure 11:
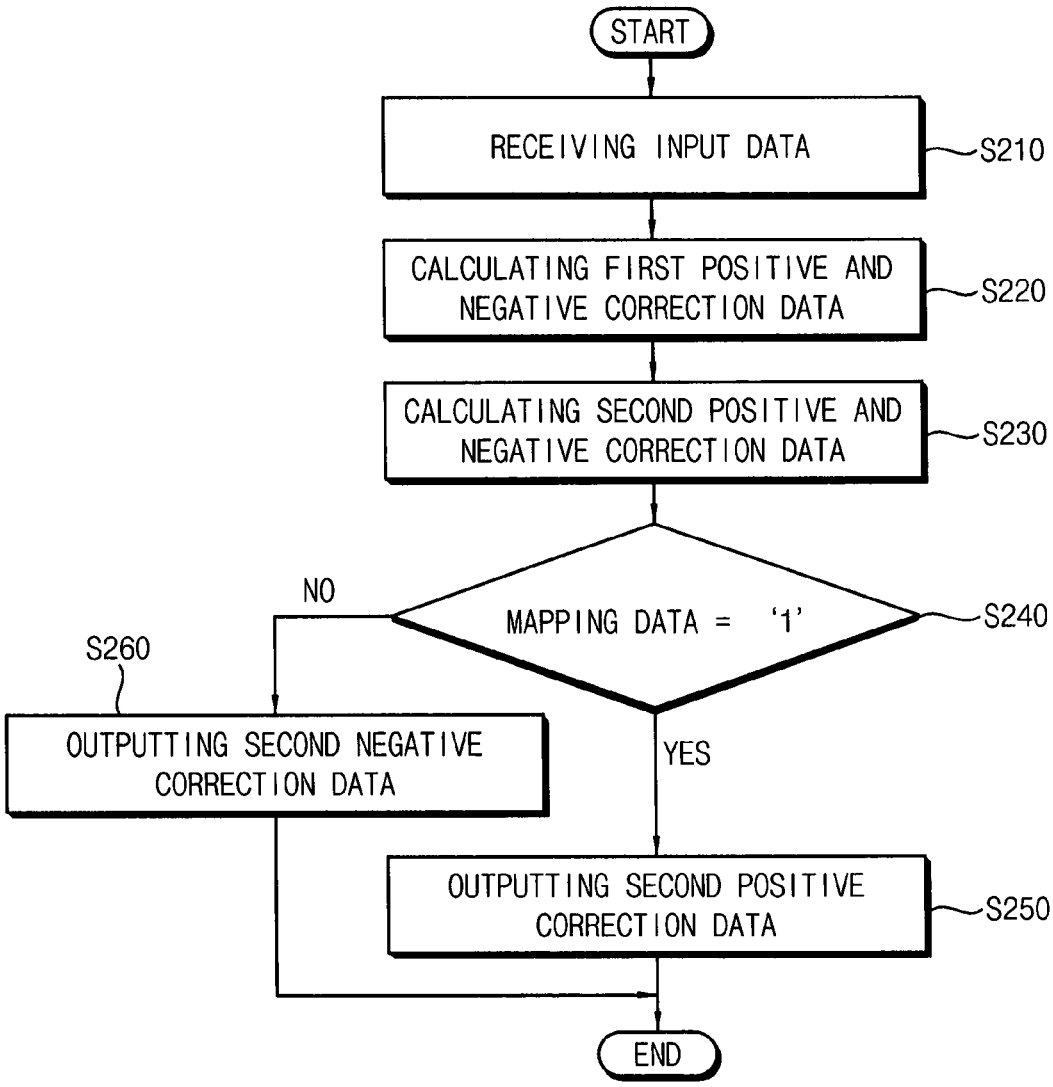
FIG. 11 is a flowchart illustrating a method of driving the vertical line corrector of FIG. 9.

FIG. 11 is a flowchart illustrating a method of driving the vertical line corrector of FIG. 9.

Referring to FIGS. 9 and 11, the input data are received (Step S210). As shown in FIG. 10, the first look up table 221*a* stores a plurality of first positive polarity correction data CD_pos corresponding to a plurality of sample grayscales which are sampled from total grayscales. The second look up table 221*b* stores a plurality of first negative polarity correction data CD_neg corresponding to a plurality of sample grayscales which are sampled from total grayscales.

The first and second look up tables 221*a* and 221*b* and the first and second interpolators 225*a* and 255*b* respectively calculate the first positive polarity correction data and the first negative polarity correction data for the input data (Step S220).

The first delay compensator 227*a* receives the first positive polarity correction data. The first delay compensator 227*a* applies a horizontal correction value provided from the memory 225 corresponding to the sub pixel position of the input data to the first positive polarity correction data and thus, calculates second positive polarity correction. The second delay compensator 227*b* receives the first negative polarity correction data. The second delay compensator 227*b* applies the horizontal correction value provided from the memory 225 corresponding to the sub pixel position of the input data to the first negative polarity correction data and thus, calculates second negative polarity correction data (Step S230).

The output selector 329 selectively outputs one of the second positive polarity correction data and the second negative polarity correction data based on the 1-bit mapping data of the normal polarity mapping data or the specified polarity mapping data stored in the memory 225.

For example, when the 1-bit mapping data are '1', the output selector 329 determines the polarity of the sub pixel corresponding to the input data to the positive polarity and outputs the second positive polarity correction data (Step S250).

Alternatively, when the 1-bit mapping data are '0', the output selector 329 determines the polarity of the sub pixel corresponding to the input data to the negative polarity and outputs the second negative polarity correction data (Step S260).

According to the exemplary embodiment, the luminance difference between the positive polarity and the negative polarity with respect to a same grayscale may be compensated. In addition, the RC delay of the gate line may be compensated. Therefore, the display defects such as the flicker and the stripe occurring by the luminance difference and the RC delay may be decreased and thus a display quality may be improved.

Figure 12:
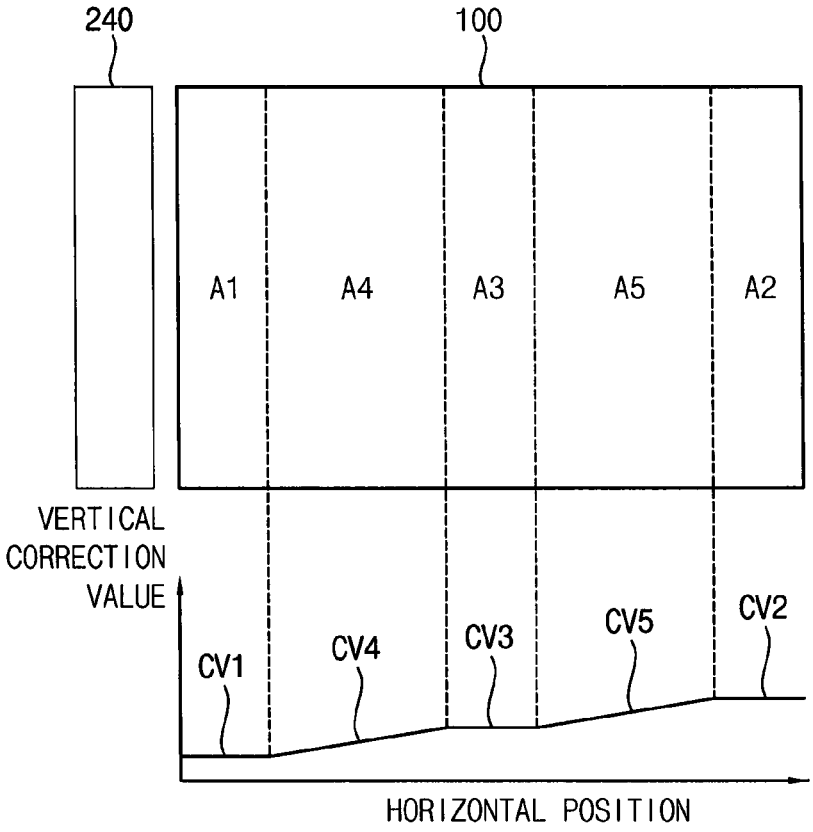
FIG. 12 is a conceptual diagram illustrating a horizontal correction value applied to a delay compensator according to an exemplary embodiment.

FIG. 12 is a conceptual diagram illustrating a horizontal correction value applied to a delay compensator according to an exemplary embodiment.

Referring to FIG. 12, the gate driver circuit 240 has a single gate structure. The gate driver circuit 240 of the single gate structure is connected to one of first and second end portions of the gate line GL and provides the gate line GL with a gate signal. The display panel driven through the gate driver circuit 240 of the single gate structure may be divided into a plurality of horizontal areas A1, A2, A3, A4 and A5 based on the RC delay of the gate signal transferred through the gate line GL.

For example, the display panel 100 may include a first area A1, a second area A2, a third area A3, a fourth area A4 and a fifth area A5. The first area A1 is adjacent to a first edge portion in which the gate driver circuit 240 is disposed. The second area A2 is adjacent to a second edge portion opposite to the first edge portion. The third area A3 corresponds to the central portion of the display panel 100. The fourth area A4 is between the first area A1 and the third area A3 and the fifth area A5 which is between the third area A3 and the second area A2.

According to the RC delay of the gate signal, a first horizontal correction value CV1 is calculated corresponding to the first area A1. A second horizontal correction value CV2 is calculated corresponding to the second area A2 and is different from the first horizontal correction value CV1. A third horizontal correction value CV3 is calculated corresponding to the third area A3. A plurality of fourth horizontal correction values CV4 is calculated using the first and third horizontal correction values CV1 and CV3 corresponding to the fourth area A4. The plurality of fourth horizontal correction values CV4 linearly increases from the first horizontal correction value CV1 to the third horizontal correction value CV3. A plurality of fifth horizontal correction values CV5 is calculated using the second and third horizontal correction values CV2 and CV3 corresponding to the fifth area A5. The plurality of fifth horizontal correction values CV5 linearly increases from the third horizontal correction value CV3 to the second horizontal correction value CV2.

As described above, the calculated horizontal correction values are stored in the memory 225. In order to compensate for the RC delay, the calculated horizontal correction values are applied to the first correction data which compensate for the luminance difference between the positive and negative polarities through the delay compensator.

Figure 13:
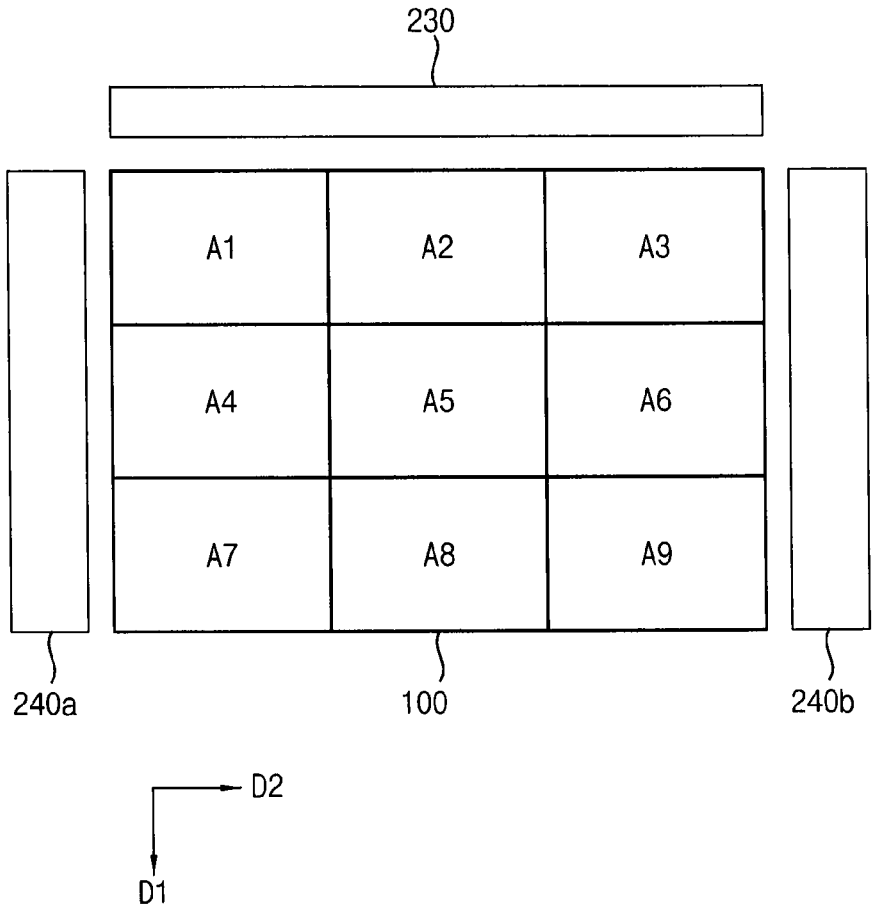
FIG. 13 is a conceptual diagram illustrating a delay compensation value applied to a delay compensator according to an exemplary embodiment.

FIG. 13 is a conceptual diagram illustrating a delay compensation value applied to a delay compensator according to an exemplary embodiment.

Referring to FIG. 13, the display panel 100 is divided into a plurality of areas such as an (M×N) matrix array (wherein, N and M are natural numbers).

The display panel 100 is divided into the plurality of areas such as the (MxN) matrix array in order to compensate for all RC delays of the gate line extending in the horizontal direction (second direction D2) and the data line extending in the vertical direction (first direction D1).

For example, the display panel 100 includes first to ninth areas A1, . . . , A9 divided as a (3×3) matrixarray.

The RC delay of the gate signal decreases in edge portions adjacent to first and second gate driver circuits 240*a* and 240*b* and increases in a central portion far away from the edge portions in which the first and second gate driver circuits 240*a* and 240*b* are disposed in the second direction D2.

The RC delay of the data signal decreases in an edge portion adjacent to a data driver circuit 230 and increases in a lower portion far away from the edge portion in which the data driver circuit 230 is disposed in the first direction D1.

As described above, based on the RC delays of the gate signal and data signal, a plurality of delay compensation values may be calculated respectively corresponding to the first to ninth areas A1, . . . , A9. The calculated delay compensation values may be stored in the memory as the previously exemplary embodiments. In order to compensate for the RC delay, the delay compensation values are applied to the first correction data which are compensated for the luminance difference between the positive and negative polarities through the delay compensator.

As described above, according to exemplary embodiments, the luminance difference between the positive polarity and the negative polarity with respect to a same grayscale may be compensated. In addition, the RC delay of the gate line may be compensated. Therefore, the display defects such as the flicker and the stripe occurring by the luminance difference and the RC delay may be decreased and thus, a display quality may be improved.

The foregoing is illustrative of the inventive concept and is not to be construed as limiting thereof. Although a few exemplary embodiments of the inventive concept have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims. In the claims, means-plus-function clauses are intended to cover the structures described herein as performing the recited function and not only structural equivalents but also equivalent structures. Therefore, it is to be understood that the foregoing is illustrative of the inventive concept and is not to be construed as limited to the specific exemplary embodiments disclosed, and that modifications to the disclosed exemplary embodiments, as well as other exemplary embodiments, are intended to be included within the scope of the appended claims. The inventive concept is defined by the following claims, with equivalents of the claims to be included therein.

What is claimed is:

1. A display apparatus comprising:

a display panel comprising a gate line, a data line crossing the gate line and a sub pixel which is electrically connected to the gate line and the data line;

a first interpolator configured to generate first correction data for a first polarity corresponding to an input data using a first look up table which stores correction data for the first polarity compensating a luminance difference which is due to liquid crystal response time later than change time of a data voltage and which is between the first polarity and a second polarity opposite to the first polarity of the data voltage for the sub pixel;

a first delay compensator configured to apply a correction value to the first correction data for the first polarity and generate second correction data for the first polarity, the correction value compensating an RC delay based on a pixel position corresponding to the input data;

an output selector configured to selectively output the second correction data for the first polarity based on polarity mapping data of K-bit (K is a natural number), the polarity mapping data mapped to polarities of K sub pixels according to an inversion mode; and a data driver circuit configured to convert the second correction data for the first polarity to replace the data voltage and output the converted second correction data to the sub pixel.

2. The display apparatus of claim 1, wherein the output selector configured to selectively output one of the second correction data for the first polarity and the input data based on 1-bit data of the polarity mapping data.

3. The display apparatus of claim 1, further comprising;

a second interpolator configured to generate first correction data for the second polarity corresponding to an input data using a second look up table which stores correction data for the second polarity compensating the luminance difference between the first polarity and the second polarity of the data voltage; and a second delay compensator configured to apply the compensation value to the first correction data for the second polarity and generate second correction data for the second polarity.

4. The display apparatus of claim 3, wherein the output selector configured to selectively output one of the second correction data for the first polarity and the second polarity based 1-bit data of the polarity mapping data.

5. The display apparatus of claim 1, further comprising:

a memory configured to store the correction value, wherein the memory stores a plurality of correction values compensating the RC delay of the gate line, the plurality of correction values respectively corresponds to a plurality of areas, and the plurality of areas is divided in a direction extending the gate line.

6. The display apparatus of claim 5, further comprising:

a first gate driver circuit connected to a first end portion of the gate line and configured to provide the gate line with a gate signal.

7. The display apparatus of claim 6, further comprising:

a second gate driver circuit connected to a second end portion of the gate line and configured to provide the gate line with a gate signal, wherein the first and second gate driver circuits provide the gate line with a same gate signal.

8. The display apparatus of claim 1, further comprising:

a memory configured to store the correction value, wherein the memory stores a plurality of correction values compensating RC delays of the gate line and the data line, the plurality of correction values respectively corresponds to a plurality of areas and the plurality of areas are divided as a matrixarray.

9. The display apparatus of claim 1, further comprising:

a memory configured to store the polarity mapping data of the K-bit, wherein the output selector selects the first polarity when the 1-bit data of the polarity mapping data is '1', and the output selector selects the second polarity when the 1-bit data of the polarity mapping data is '0'.

10. The display apparatus of claim 9, wherein the memory configured to store specified polarity mapping data of Q-bit (Q is a natural number) corresponding to a specified test pattern image.

11. A method of driving a display apparatus which comprises a gate line, a data line crossing the gate line and a sub pixel which is electrically connected to the gate line and the data line, the method comprising:

calculating first correction data for a first polarity corresponding to an input data using a first look up table which stores correction data for the first polarity compensating a luminance which is due to liquid crystal response time later than change time of a data voltage and which is difference between the first polarity and a second polarity opposite to the first polarity of the data voltage for the sub pixel;

applying a correction value to the first correction data for the first polarity to calculate second correction data for the first polarity, the correction value compensating an RC delay based on a pixel position corresponding to the input data;

selectively outputting the second correction data for the first polarity based on polarity mapping data of K-bit ('K' is a natural number), the polarity mapping data being mapped to polarities of K sub pixels according to an inversion mode; and converting the second correction data for the first polarity to replace the data voltage to output to the sub pixel.

12. The method of claim 11, wherein the selectively outputting the second correction data comprises:

selectively outputting one of the second correction data for the first polarity and the input data based on 1-bit data of the polarity mapping data.

13. The method of claim 11, further comprising;

calculating first correction data for the second polarity corresponding to an input data using a second look up table which stores correction data for the second polarity compensating the luminance difference between the first polarity and the second polarity of the data voltage; and applying the correction value to the first correction data for the second polarity to calculate second correction data for the second polarity.

14. The method of claim 13, further comprising;

selectively outputting one of the second correction data for the first polarity and the second polarity input data based on 1-bit data of the polarity mapping data.

15. The method of claim 11, wherein the second correction data is calculated using a plurality of correction values compensating the RC delay of the gate line, the plurality of correction values respectively corresponding to a plurality of areas, the plurality of areas being divided in a direction extending the gate line.

16. The method of claim 15, further comprising:

providing a first end portion of the gate line with a gate signal.

17. The method of claim 16, further comprising:

providing a second end portion of the gate line with a gate signal, wherein the first and second end portions of the gate line receive a same gate signal.

18. The method of claim 16, wherein the second correction data is calculated using a plurality of correction values compensating RC delays of the gate line and the data line, the plurality of correction values respectively corresponding to a plurality of areas, the plurality of areas being divided as a matrixarray.

19. The method of claim 11, wherein the first polarity is selected when the 1-bit data of the polarity mapping data is '1', and the second polarity is selected when the 1-bit data of the polarity mapping data is '0'.

20. The method of claim 19, wherein the calculating the second correction data further comprises:

selectively outputting the second correction data corresponding to the input data based on specified polarity mapping data of Q-bit (Q is a natural number) corresponding to a specified test pattern image.

* * * * *